United States Patent [19]

Viner

[11] Patent Number: 4,720,878

[45] Date of Patent: Jan. 26, 1988

[54] DISMANTLABLE EVAPORATIVE COOLING SHOWER

[76] Inventor: Stephen G. Viner, 1066 S. Ogden Dr., Los Angeles, Calif. 90019

[21] Appl. No.: 939,067

[22] Filed: Dec. 8, 1986

[51] Int. Cl.[4] ..... A47K 3/22; A47G 23/02

[52] U.S. Cl. ..... 4/615; 4/647; 4/648; 248/150

[58] Field of Search ..... 4/598, 603, 615, 596, 4/601, 602, 605, 616, 617, 597, 647, 648

[56] References Cited

U.S. PATENT DOCUMENTS

| | | | |
|---|---|---|---|
| 2,005,196 | 6/1935 | Mears | 4/615 X |
| 3,962,733 | 6/1976 | Parry | 4/615 |
| 3,982,284 | 9/1976 | Becker | 4/615 |

FOREIGN PATENT DOCUMENTS

| | | | |
|---|---|---|---|
| 49164 | 8/1934 | Denmark | 4/598 |
| 826628 | 1/1952 | Netherlands | 4/603 |
| 357205 | 9/1931 | United Kingdom | 4/603 |
| 2060368 | 5/1981 | United Kingdom | 4/598 |

*Primary Examiner*—Henry K. Artis

*Attorney, Agent, or Firm*—Philip D. Junkins

[57] ABSTRACT

A portable cooling and refreshment shower assembly including dismantlable pipe sections supporting and interconnected with a showerhead structure at its upper end and supported in its vertical orientation by radially extending base pipe sections. The base pipe sections are dismantlable from the pipe sections supporting the showerhead. A water supply connection is provided the shower assembly and water fills the base pipe sections to provide ballast to the shower structure during operation of the shower.

4 Claims, 3 Drawing Figures

DISMANTLABLE EVAPORATIVE COOLING SHOWER

BACKGROUND OF THE INVENTION

This invention relates to portable shower equipment which is readily dismantlable for compact storage. More particularly, the present invention relates to an outdoors portable and dismantlable shower for bathing, refreshment and cooling while working or sunbathing, at pool-side, or while participating in sports activities or for use as a plant watering sprayer.

It is a principal object of the present invention to provide a portable shower which is of extremely simplistic design and which may be easily assembled and dismantled.

Another object of this invention is to provide a portable and dismantlable shower which is principally designed to provide refreshment and cooling to the person utilizing the shower by evaporation of the water sprayed onto the person.

SUMMARY OF THE INVENTION

The portable bathing and refreshment shower of the invention is essentially comprised of a vertically extending water feed pipe consisting of dismantlable plastic pipe sections supporting and interconnected with a showerhead structure at its upper end and supported in its vertical orientation by radially extending base pipe sections. The base pipe sections are dismantlable from the feed pipe. A water supply connection is provided in the lower feed pipe section or in one of the base pipe sections and water fills the base pipe sections to provide ballast to the shower structure during operation of the shower.

The principal advantages of the invention are the provision of an extremely compact and portable refreshment and bathing shower which is easy to assemble and operate. Further advantages of the invention will become apparent from the description hereinbelow.

BRIEF DESCRIPTION OF THE DRAWING FIGURES

The invention is illustrated in the accompanying drawing figures in which.

DETAILED DESCRIPTION OF THE INVENTION

Figure 1:
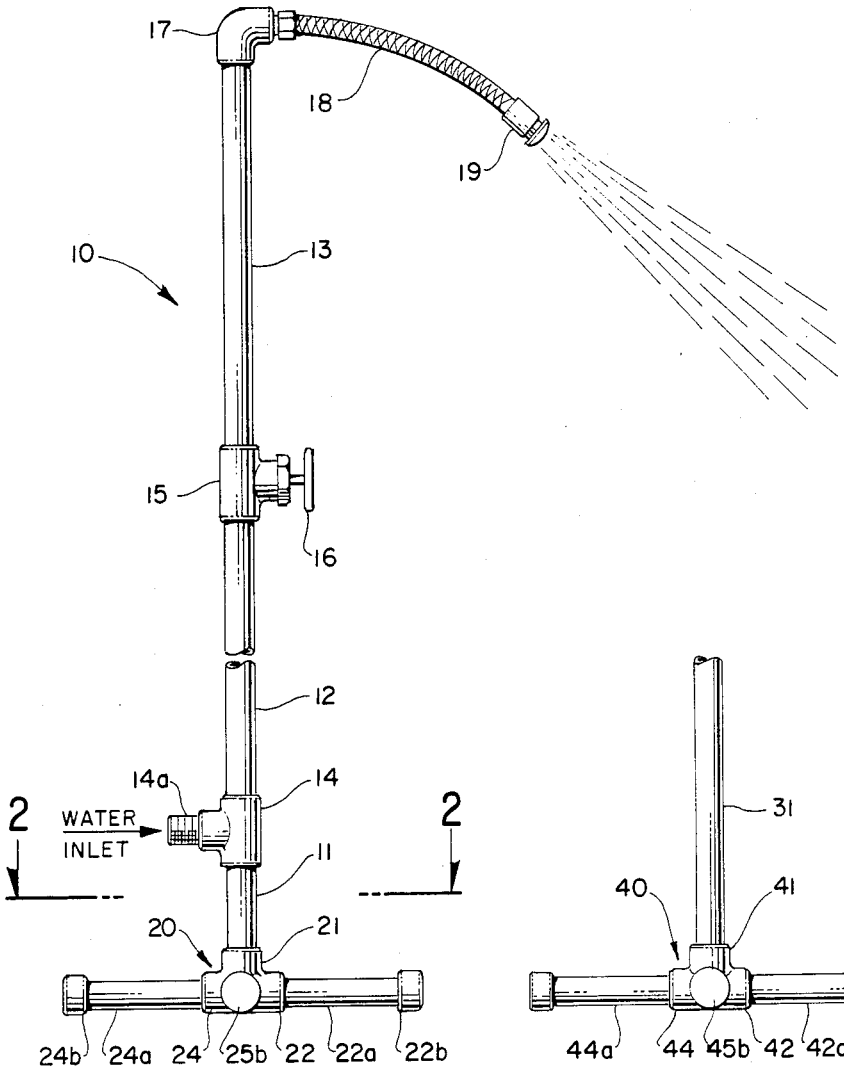
FIG. 1 is a front view of the shower equipment comprising the portable and dismantlable shower of my invention.
Figure 2:
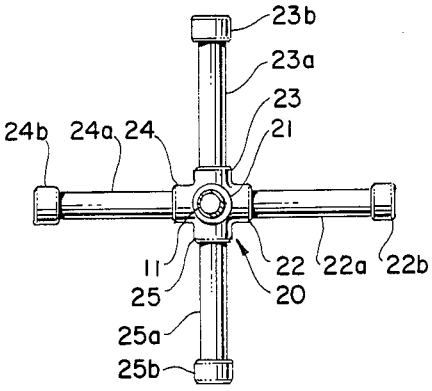
FIG. 2 is a top view of the shower equipment arrangement of FIG. 1 taken on line 2—2 of FIG. 1.

A preferred embodiment of my improved portable and dismantlable evaporative cooling shower is shown in FIGS. 1 and 2. The shower structure 10 is comprised of vertically extending dismantlable water feed pipe sections 11, 12 and 13 interconnected by appropriate threaded pipe Joints 14 and 15. The feed pipe sections 11, 12 and 13 are preferably formed of polyvinyl chloride (PVC) plastic material which has been ultraviolet stabilized for long life during outdoors exposure to sun light. The threaded pipe joint 14 (connecting pipe section 11 and pipe section 12) may be formed of PVC plastic or brass and, as illustrated in FIG. 1, includes a side water inlet connection **14*a* for attachment of the shower structure to a standard water hose (not shown). The threaded pipe joint 15 (connecting pipe section 12 and pipe section 13) may also be formed of PVC plastic or brass and, as illustrated in FIG. 1, includes on/off valve 16** to control the flow of water through the shower structure.

At the upper end of feed pipe section 13 there is attached elbow joint 17 which interconnects the water feed pipe sections with a section of flexible metal sheath tubing 18 and a spray nozzle 19. The elbow joint 17 is threaded and may be formed of PVC plastic or brass. The flexible tubing 18 is threaded at each of its ends. The nozzle 19 may be of either regular shower type, misting spray type (for evaporative cooling) or of fan spray type for watering plants.

The interconnected feed pipe sections, with flexible tubing and spray nozzle, are supported in vertical orientation by a base support assembly comprised of a special cross joint 20 (having a vertical pipe connect portion 21 and radially extending horizontal pipe connect portions 22, 23, 24 and 25) and interconnected base pipes **22*a*, 23*a*, 24*a* and 25*a* with pipe caps or pipe plugs 22*b*, 23*b*, 24*b* and 25*b*, respectively. The cross joint 20 is formed of UV stabilized PVC plastic and in its pipe connect portions 22, 23, 24 and 25 may be cemented to base pipes 22*a*, 23*a*, 24*a* and 25*a*, respectively. The pipe caps (or alternatively, pipe end plugs) are cemented to their respective base pipes and close the pipe work of the base support assembly except for pipe connect portion 21 which interconnects the base support assembly with vertical feed pipe section 11. When water is introduced to the shower assembly 10 through water inlet 14*a* the base support assembly of the structure fills with water and the weight of such water within base pipes 22*a*, 23*a*, 24*a* and 25*a*** acts as ballast to stabilize and support the vertical feed pipe sections and showerhead components of the shower.

Figure 3:
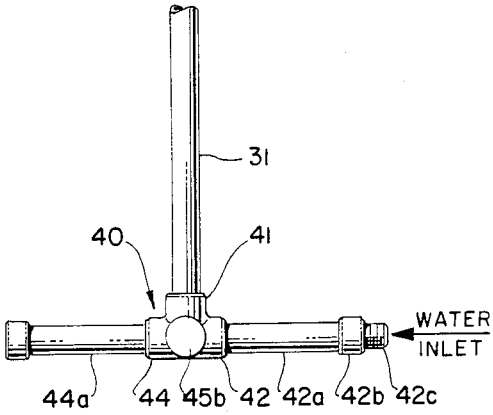
FIG. 3 is a partial front view of an alternative form of the shower equipment comprising the portable and dismantlable shower of the invention.

A portable and dismantlable shower in accordance with the present invention, as illustrated in FIGS. 1 and 2, has been fabricated using UV stabilized PVC pipe sections having an outside diameter of 1¼" with appropriately sized pipe joints, connectors and caps made of brass. Although for most uses PVC plastic pipe sections are joined by adhesives, for application in the present shower structure the PVC plastic pipe sections have machine threads at their ends for tight assembly and disassembly to associated threaded pipe joints. To assure watertight sealing at the assembly joints "O" ring seals are included for abutment with the threaded pipe section ends within the joints In FIG. 3 there is shown a partial front view of an alternative form of the shower equipment of the present invention. As shown in the figure the lower water feed pipe section 31 does not include a pipe joint having a side water inlet connection. Rather, water hose connection to the shower structure is accomplished via one of the base pipes. The cross joint 40 (of the base structure) is threaded to feed pipe section 31 through pipe connect portion 41. Pipe connect portion 42 of cross joint 40 is interconnected to base pipe **42*a*. Rather than being enclosed at its radially extended end by a pipe cap, the base pipe 42*a* is provided with a threaded pipe joint 42*b* which includes a water inlet connection 42*c* adapted to receive a water hose. The remaining structure of the shower assembly of FIG. 3 (not shown) is similar to the shower structure as shown in FIGS. 1 and 2**.

The portable bathing and cooling shower or plant watering device of the present invention is readily assembled and disassembled. The area and velocity of sprayed water may be regulated by the type of spray nozzle affixed to the flexible tubing of the showerhead structure. The volume of water passing through the shower structure is regulated through the on/off valve interconnecting two of the vertical feed pipe sections of the shower assembly. It is to be understood that the shower assembly of the present invention is not enclosed. It is intended for use by bathers or athletes participating in sports activities or for use as a plant watering sprayer. The refreshment effect of the invention as a cooling shower is realized by evaporation of part of the water spray in contact with the body of the person using the shower with the release of Btus of body heat and concurrent cooling of the persons body.

In considering this invention it should be understood that the present disclosure is illustrative only and the scope of the invention is to be determined by the appended claims.

What is claimed is:

1. A portable water shower assembly comprising: a vertically-extending water feed pipe including at least two dismantlable pipe sections and bearing an interconnected showerhead at its upper end in water flow communication with said feed pipe; a multiple pipe joint connector having a vertically-extending leg and at least three horizontal radially-extending, uniformly-spaced legs, said vertically-extending leg interconnected to the lower end of said water feed pipe; base pipe sections closed at their respective outer ends and interconnected in water flow communication at their inner ends to the radially-extending legs of said pipe joint connector for supporting said water feed pipe in its vertical orientation; and means for introducing water to said assembly for passage through the pipe sections of said water feed pipe to and through said showerhead and for filling said base pipe sections to provide ballast at the base of said shower assembly to maintain said assembly in its vertical orientation during periods of use.

2. A portable water shower assembly as claimed in claim 1 wherein the means for introducing water to said shower assembly comprises a "T" pipe joint interconnecting a pair of the dismantlable pipe sections of said water feed pipe and a water supply hose connected to one leg of said "T" pipe joint.

3. A portable water shower assembly as claimed in claim 1 wherein the means for introducing water to said shower assembly comprises a pipe joint interconnecting the outer end of one of said base pipe sections with a water supply hose.

4. A portable water shower assembly as claimed in claim 1 wherein the dismantlable pipe sections of said vertically-extending feed pipe, multiple pipe joint connector, and the base pipe sections of said assembly are formed of polyvinyl chloride plastic material which has been ultraviolet light stabilized against sun light exposure and are threaded at their end areas of interconnection with one another.

* * * * *